US005657809A

United States Patent [19]

Longoria et al.

[11] Patent Number: 5,657,809

[45] Date of Patent: Aug. 19, 1997

[54] SECURITY GATE

[75] Inventors: Jose Longoria, Miami, Fla.; Stephen P. Chininis, Norcross, Ga.

[73] Assignee: Kids II, Inc., Alpharetta, Ga.

[21] Appl. No.: 523,120

[22] Filed: Sep. 1, 1995

[51] Int. Cl.[6] ..... A47H 3/00

[52] U.S. Cl. ..... 160/369; 160/160; 160/375; 160/377; 49/57; 49/465

[58] Field of Search ..... 160/371, 375, 160/377, 210, 212, 217, 218, 219, 220, 221, 222, 223, 224, 225, 226, 227, 228, 369, 160; 49/50, 57, 463, 465

[56] References Cited

U.S. PATENT DOCUMENTS

| | | | |
|---|---|---|---|
| 646,120 | 3/1900 | Gallaher | 160/375 |
| 907,546 | 12/1908 | Warner | 160/160 X |
| 1,091,652 | 3/1914 | Hall | 160/160 |
| 1,148,513 | 8/1915 | Hoyt | 160/375 |
| 1,215,462 | 2/1917 | Agee et al. . | |
| 1,501,545 | 7/1924 | Piffard-Francis . | |
| 1,532,769 | 4/1925 | McElroy . | |
| 2,001,181 | 5/1935 | Burcham . | |
| 2,262,800 | 11/1941 | Farmer . | |
| 2,310,539 | 2/1943 | Nelson et al. . | |
| 2,581,857 | 1/1952 | Harrison | 160/217 X |
| 2,600,712 | 6/1952 | Weinberg | 160/160 |
| 2,701,927 | 2/1955 | Dyer . | |
| 2,851,746 | 9/1958 | McPhaden . | |
| 2,928,146 | 3/1960 | Kuniholm | 49/465 |
| 3,680,260 | 8/1972 | Bauer | 160/217 X |
| 3,885,616 | 5/1975 | Berkowitz | 160/222 X |
| 4,671,012 | 6/1987 | Merklinger et al. . | |
| 4,787,174 | 11/1988 | Brown . | |
| 5,367,829 | 11/1994 | Crossley et al. . | |
| 5,437,115 | 8/1995 | Freese et al. | 49/57 X |

FOREIGN PATENT DOCUMENTS

| | | | |
|---|---|---|---|
| 127698 | 2/1947 | Australia | 160/217 |

*Primary Examiner*—David M. Purol

*Attorney, Agent, or Firm*—Beveridge, DeGrandi, Weilacher & Young, L.L.P.

[57] ABSTRACT

A security device for obstructing movement of children or animals through an entryway includes a barrier mounted on a frame. The frame is made of substantially linear and rigid bars which are pivoted together to form one collapsible parallelogram which extends substantially entirely across the entryway. A movable pressure member is mounted on a vertical bar of the frame for laterally outward movement when the vertical bar moves down relative to the pressure member. To facilitate collapse of the frame to a position where all of the bars are parallel, each of two diametrically opposed pivots has its axis inwardly offset from the longitudinal axis of one of the bars it interconnects, and the barrier member is a net in which rectangular openings are formed by members which are substantially parallel to the bars. A frame-supporting hinge has a generally vertical hinge axis to permit horizontal swinging movement of the device.

31 Claims, 10 Drawing Sheets

FIG. 7
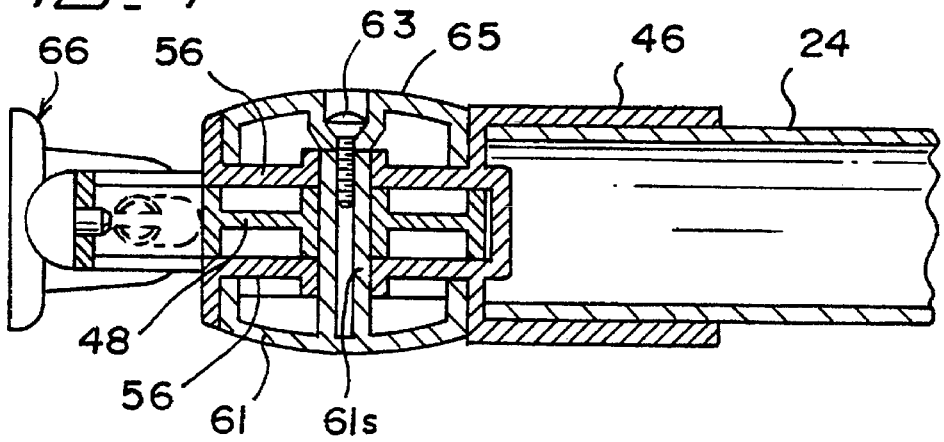
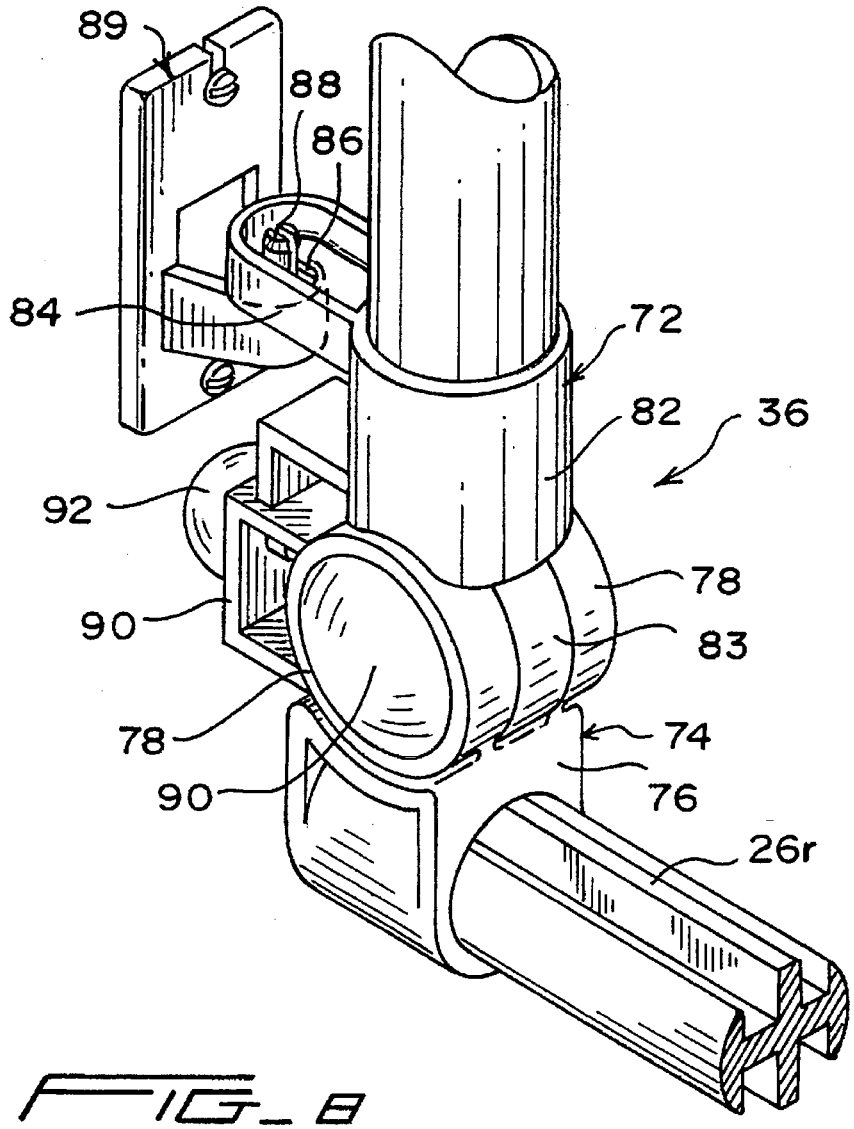
FIG. 8

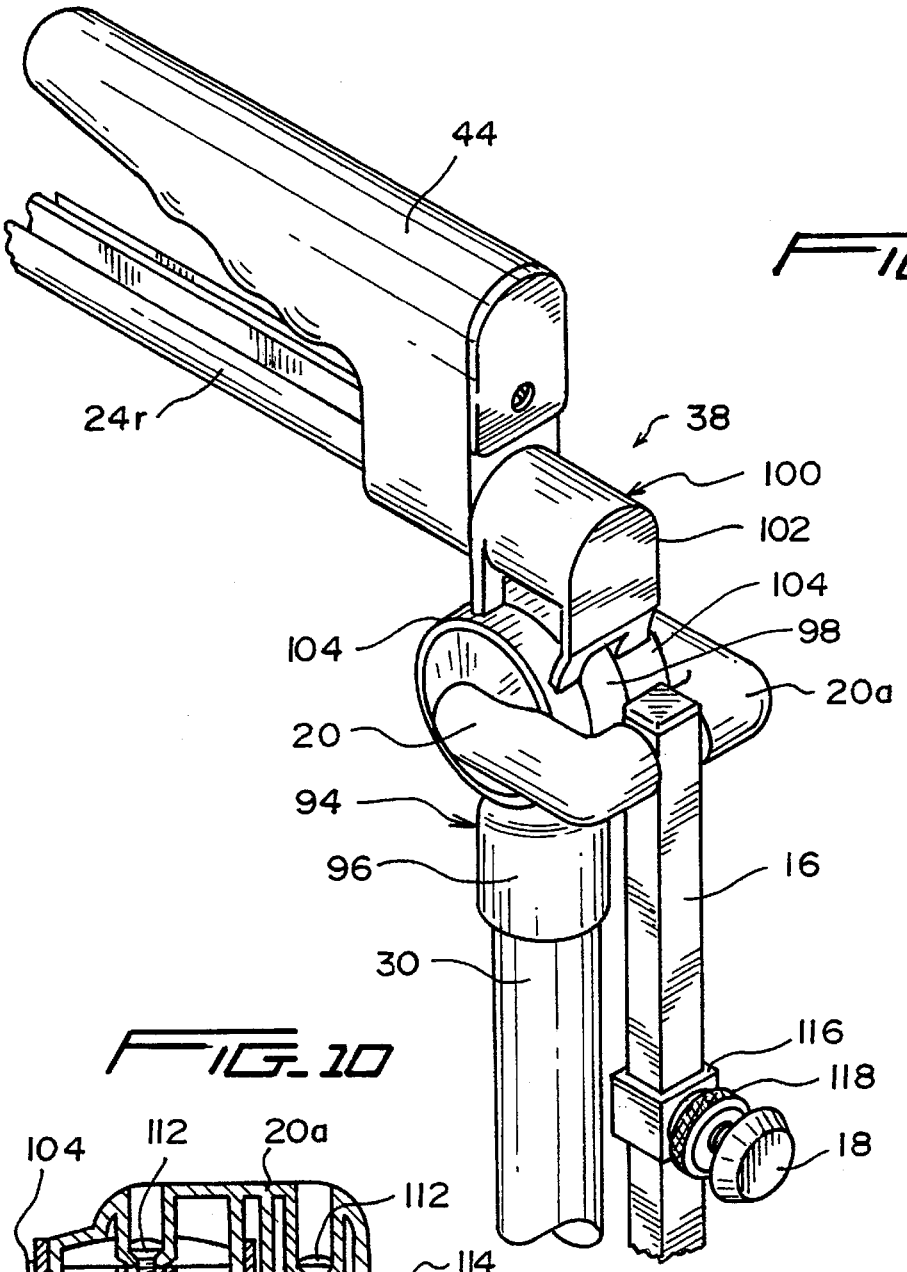
FIG. 9
FIG. 10
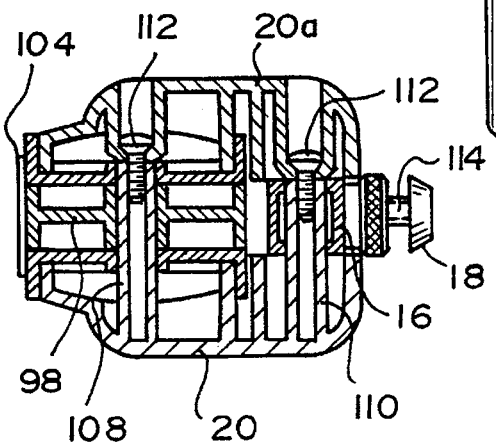
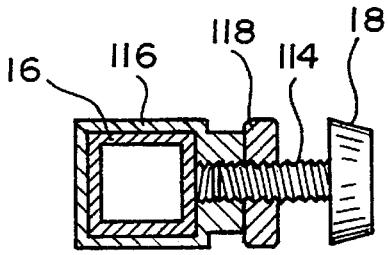
FIG. 11

SECURITY GATE

BACKGROUND OF THE INVENTION

This invention relates to security gates which are used to obstruct the movement of children or animals through doorways and other entryways.

There have been many different types of security gates. One early design which continues to be used is formed of a plurality of inclined slats pivotally interconnected to define diamond-shaped openings. One vertical side bar is hinged to one side of a doorway, and another vertical side bar is detachably connected to the other side of the doorway. The pivoted connections between the slats permits horizontal expansion of the device to fit doorways of different widths.

Most modern security gates are formed of two rigid rectangular frames or panels which are slidably connected together to permit adjustments to accommodate various doorway widths. In pressure gates, outboard vertical side bars are biased by various mechanisms against the opposite surfaces of a doorway. In one product, overcenter locking bars are mounted on both of the outboard vertical bars of a frame. Some gates are optionally operable as swing gates or pressure gates.

In another currently available device, a rigid horizontally expandable rectangular frame supports a barrier formed of nylon netting. The frame can be broken down for portability.

The present invention is believed to offer some benefits. It can be easily collapsed for storage into a transversely compact configuration. It is easily installed and removed from a doorway. It can be securely locked in a doorway, and it provides an attractive appearance. Other attributes will be appreciated by persons familiar with the field of the invention.

SUMMARY OF THE INVENTION

In one respect, the invention involves a security gate which includes a frame with a horizontal top bar, a horizontal bottom bar, a first vertical side bar, and a second vertical side bar. The bars are substantially linear and rigid, and they are connected together to form one parallelogram which extends substantially entirely across the doorway. A first pivot connects the first vertical side bar to the top bar; a second pivot pivotally connects the first vertical side bar to the bottom bar; a third pivot connects the second vertical side bar to the top bar; and, a fourth pivot connects the second vertical side bar to the bottom bar. The axes of these pivots are substantially parallel. A barrier is mounted on the frame to obstruct its central area to prevent a child or animal from moving through the doorway. One fixed pressure member is mounted at a fixed position on the first vertical side bar for pressing against the first surface of the doorway; and, one movable pressure member is movably supported on the second vertical side bar for pressing against the second surface of the doorway. The movable pressure member is movable vertically and horizontally relative to the second vertical side bar and, more specifically, it moves laterally outwardly from the second vertical side bar in response to downward movement of the second vertical side bar relative to the movable pressure member.

From another perspective, the invention includes a security gate with a frame which has pivotally interconnected bars which support a barrier as described in the previous paragraph, and the barrier is formed of flexible sheet material. Specifically, the barrier has elongated flexible members which are substantially parallel to the bars and are interconnected to form a net with rectangular openings.

In another respect, the invention involves improvements in a security gate which has a frame as described above, wherein the pivots are located to facilitate collapse of the frame to a position where all four bars are substantially parallel. According to this feature of the invention, two diagonally opposed pivots each have a pivot axis inwardly offset from the longitudinal axis of at least one of the bars which interconnects.

A further principal aspect of the invention involves a security gate with a frame as described above, and a frame-supporting hinge which supports the frame in the doorway. The hinge has a generally vertical hinge axis to permit horizontal swinging movement of the security gate.

According to more specific features utilized the preferred embodiments of the invention, the first vertical side bar is at a fixed elevation, and the second vertical side bar is vertically movable. A movable pressure surface is provided on an overcenter bar which is movably supported on the second vertical side bar by a pair of parallel links. Each of these links has two spaced apart pivots which are respectively located on the second vertical side bar and the overcenter bar. Each link has a pivot axis which coincides with the axis of one of the third and fourth pivots. The links are vertically swingable to change the effective overall width of the gate by changing the distance between the overcenter bar and the vertical side bar on which it is mounted.

A frame-supporting hinge includes a first hinge member provided with a hinge pin, and a second hinge member provided with an opening which receives the hinge pin. The opening is substantially larger than the hinge pin so that the first and second members are relatively movable in a horizontal direction. One of the hinge members is connected to a pressure member for frictionally engaging the vertical surface.

To prevent the parallelogram frame from collapsing excessively when the device is manipulated, a releasable detent limits the upward inclination of the top and bottom bars when the second vertical bar is raised.

The horizontal bars are each formed of two slidably interconnected portions to provide adjustable lengths, and means are provided for locking the slidably interconnected portions against sliding movement to fix the lengths of the horizontal bars.

BRIEF DESCRIPTION OF THE DRAWINGS

FIG. 7 is a sectional view as seen on the lines 7—7 in FIG. 5.

FIG. 8 is a perspective view of the lower left corner pivot assembly.

FIG. 9 is a perspective view of the upper right corner pivot assembly.

FIG. 10 is a sectional view taken through the pivot and link associated with the upper right corner pivot assembly.

FIG. 11 is a sectional view of a bumper mounted on the overcenter locking bar.

DESCRIPTION OF PREFERRED EMBODIMENTS

Figure 1:
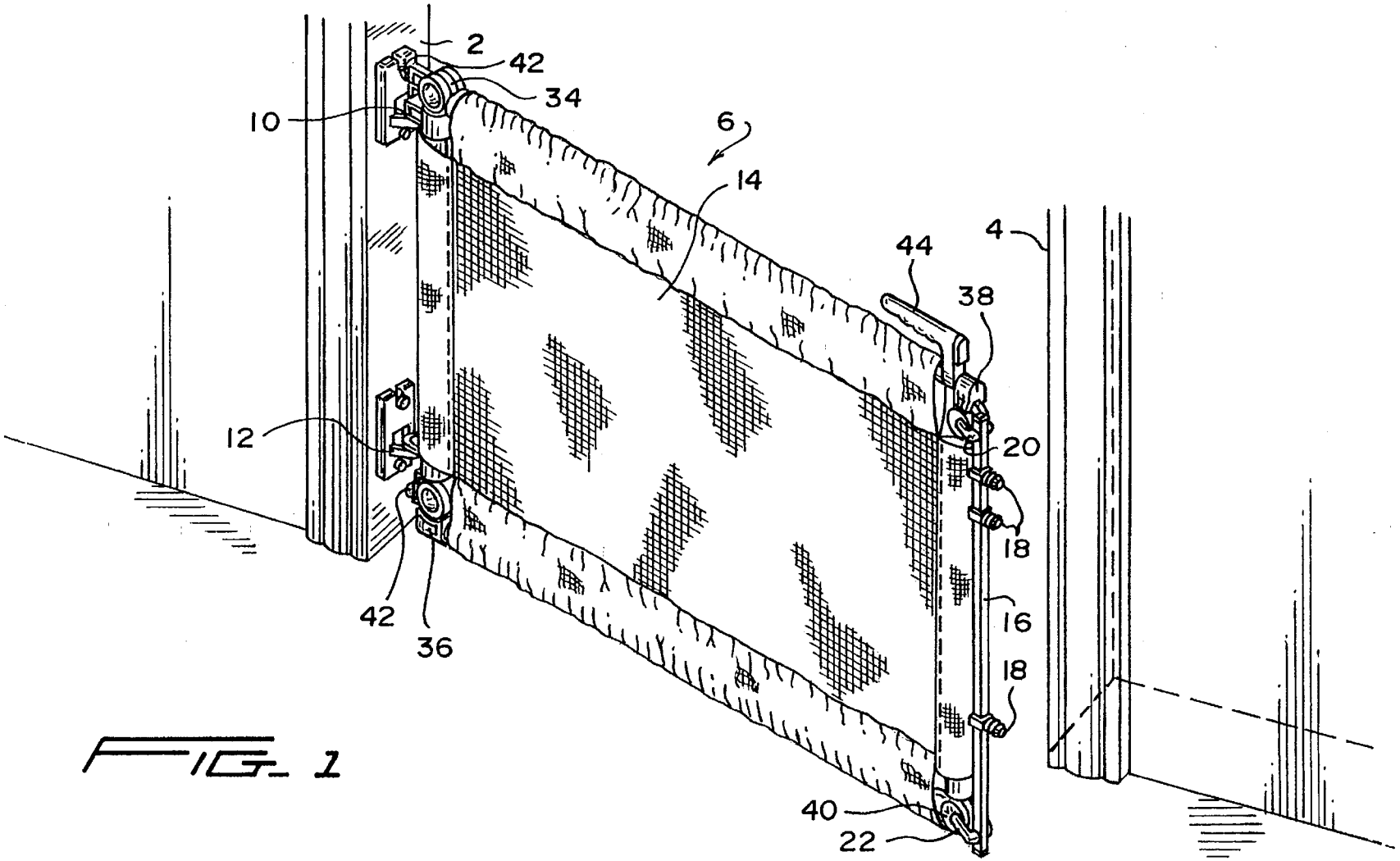
FIG. 1 is a perspective view of a security gate according to the invention in a released and partially open position.
Figure 2:
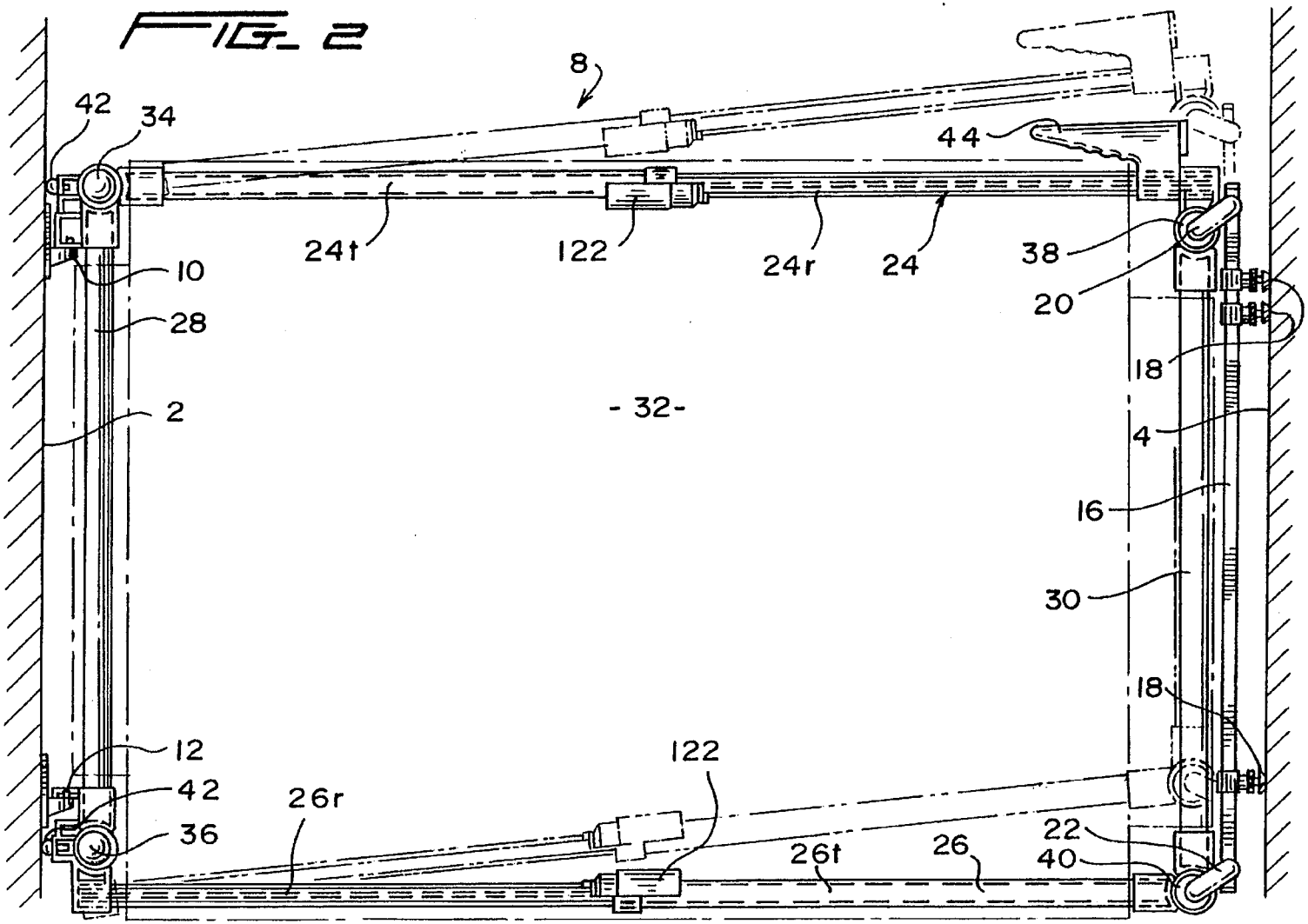
FIG. 2 is a front view of the frame used in the gate of FIG. 1.

FIGS. 1 and 2 show a first embodiment of the invention mounted in a typical entryway, a doorway having its opposite sides defined by a first surface 2 on the left and a second surface 4 on the right. The device 6 has a frame 8 (FIG. 2) supported from surface 2 by hinges 10 and 12 which have generally vertical hinge axes to permit horizontal swinging movement. A handle 44 is located near the upper right corner of the frame. A barrier 14, preferably formed of nylon net fabric, obstructs the central area of the frame. To facilitate collapsing movement of the frame as will be subsequently described, the fabric is preferably a net which has rectangular openings formed by threads, yarns or other elongated flexible members which are substantially parallel to the bars of the frame. An overcenter locking bar 16 with bumpers 18 or another doorway-engaging pressure surface is mounted on the right side of the frame by vertically movable upper links 20 and lower links 22. The overcenter bar 18 is adjacent to the vertical side bar 30.

Referring to FIG. 2, it will be seen that the frame 8 has a horizontal top bar 24, a horizontal bottom bar 26, a first vertical side bar 28, and a second vertical side bar 30. These bars are substantially linear and rigid, and they are connected together to form one parallelogram which extends substantially entirely across the doorway. The bars form the boundaries of a central area 32 which is obstructed by the fabric barrier 14 to prevent a child or animal from moving through the doorway. FIG. 2 shows the location of the barrier fabric in dot-dash lines.

The bars are connected together by four corner pivot assemblies. The first corner pivot assembly 34 includes a first pivot which pivotally connects the first vertical side bar 28 to the top bar 24. The second corner pivot assembly 36 has a second pivot which pivotally connects the first vertical side bar 28 to the bottom bar 26. The third corner pivot assembly 38 has a third pivot which connects the second vertical side bar 30 to the top bar 24, and the fourth corner pivot assembly 40 includes a fourth pivot which pivotally connects the second vertical side bar 30 to the bottom bar 26.

The pivot axes provided by the corner pivot assemblies 34, 36, 38 and 40 are substantially parallel to each other and are perpendicular to the plane of the frame 8. Thus, the frame 8 is a collapsible parallelogram. This can be seen in FIG. 2 where the rectangular configuration of the frame is shown in solid lines and a raised and partially collapsed configuration of the frame is shown in double dot lines.

The frame-supporting hinges 10 and 12 permit the device 6 to swing open when it is unlocked, but they do not actively participate in the locking function. Rather, the device 6 is locked in the doorway by pressure surfaces which bear against the opposite doorway surfaces 2 and 4 to frictionally retain the device in position. The pressure members or bumpers 42 on the left side of the device are fixed in the respect that they do not move outwardly relative to the frame to perform the locking action. Such outward movement is a function of the laterally movable bumpers 18 on the right side of the device. These bumpers 18 are movable pressure members in the respect that they are movably mounted on the vertical side bar 30. They move in response to downward movement of the vertical side bar 30 relative to the overcenter bar 16 and bumpers 18. The vertical swinging movement of the links 20 and 22 changes the effective overall width of the device 6 by changing the distance between the overcenter bar 16 and the vertical side bar 30 on which it is mounted. Each of these links 20 and 22 has two pivot axes which are spaced apart and are located respectively on the vertical side bar 30 and the overcenter bar 16. One of these pivot axes on each link coincides with a respective corner pivot of the frame.

Figure 3:
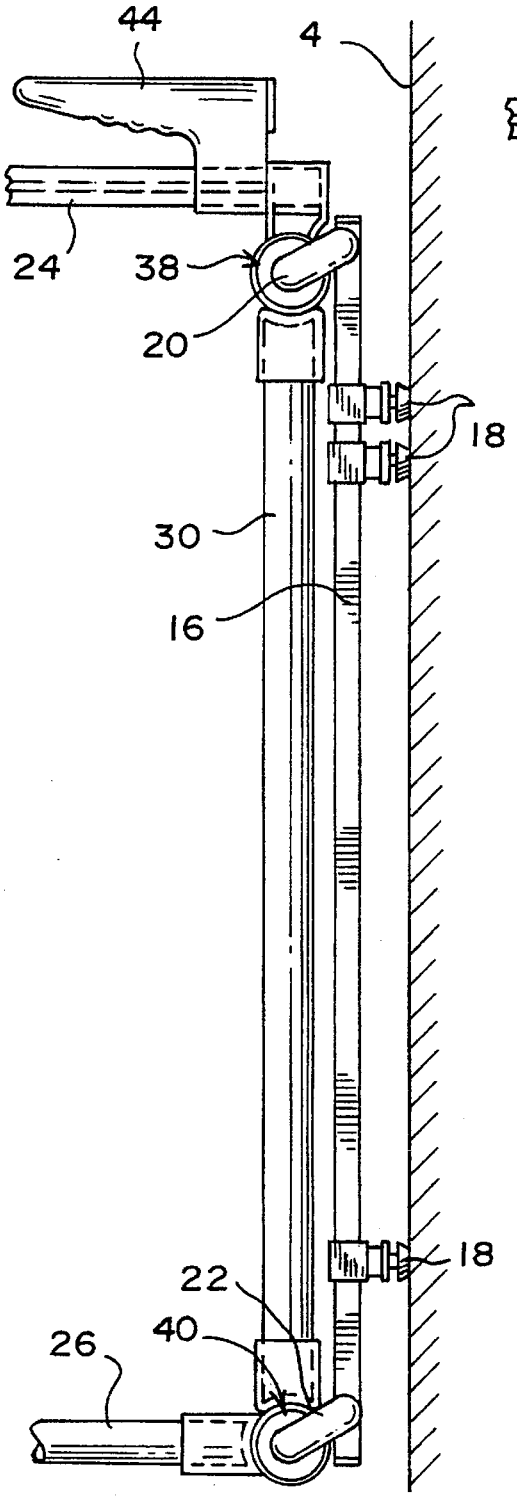
FIGS. 3 and 4 are front views of the right frame portion of the gate, respectively showing the gate in its locked and unlocked conditions.
Figure 4:
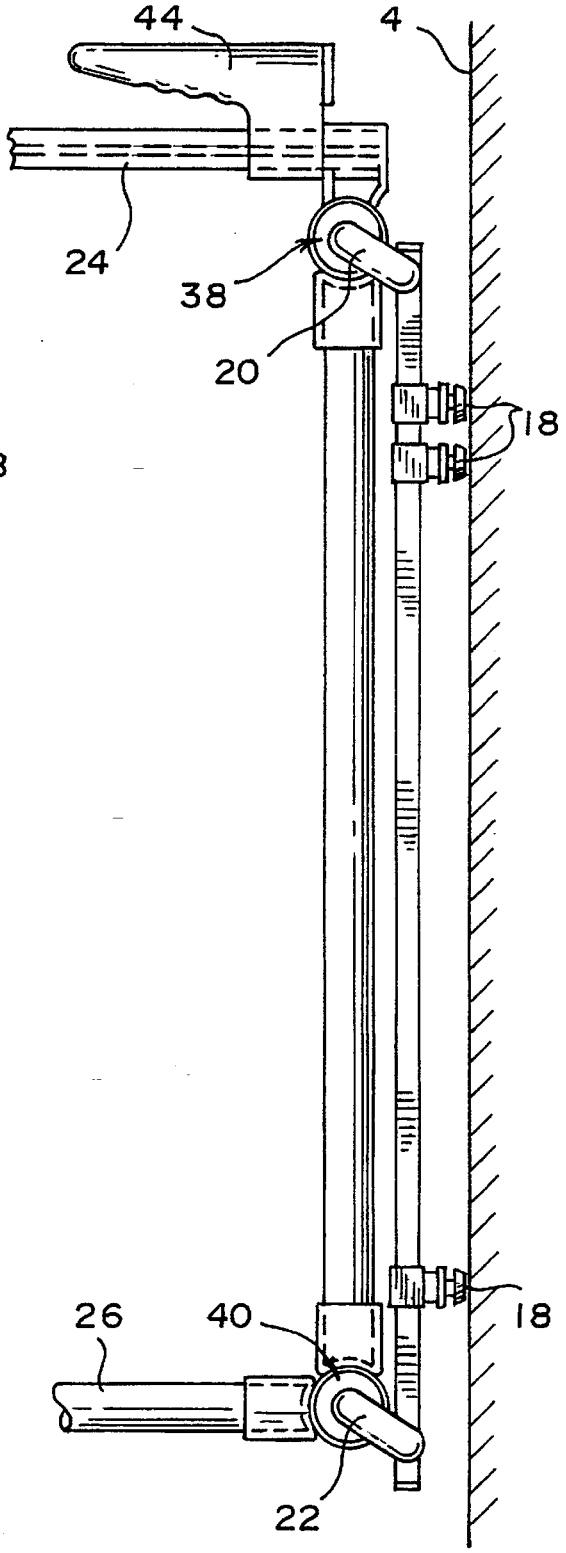

The bumpers 18 frictionally engage the right doorway surface 4 when the overall width of the device 6 is increased due to vertical swinging movement of the links 20 and 22. This is illustrated in FIGS. 3 and 4 where FIG. 3 shows the bumpers 18 in their extended positions and the overcenter bar 16 in its upper position when the frame is frictionally retained in the doorway. When the handle 44 is lifted, the vertical side bar 30 is raised, the links 20 and 22 swing in a clockwise direction, and the overcenter bar 16 moves to the retracted position shown in FIG. 4 to release the bumpers from engagement with the doorway surface 4. At this point, the frame 8 will be in its partially collapsed position shown by the double dot lines in FIG. 2.

To relock the device 6 in the doorway, the opposite steps are performed. The frame 8 is brought to the position shown in FIG. 4 and the right side of the frame is moved down until the bumpers 18 engage the doorway surface 4. Continued movement causes the vertical side bar to move downwardly relative to the overcenter bar 16, thus causing the links 20 and 22 to swing and the overcenter bar 16 and its bumpers 18 to move out to the locked position shown in FIG. 3.

Figure 5:
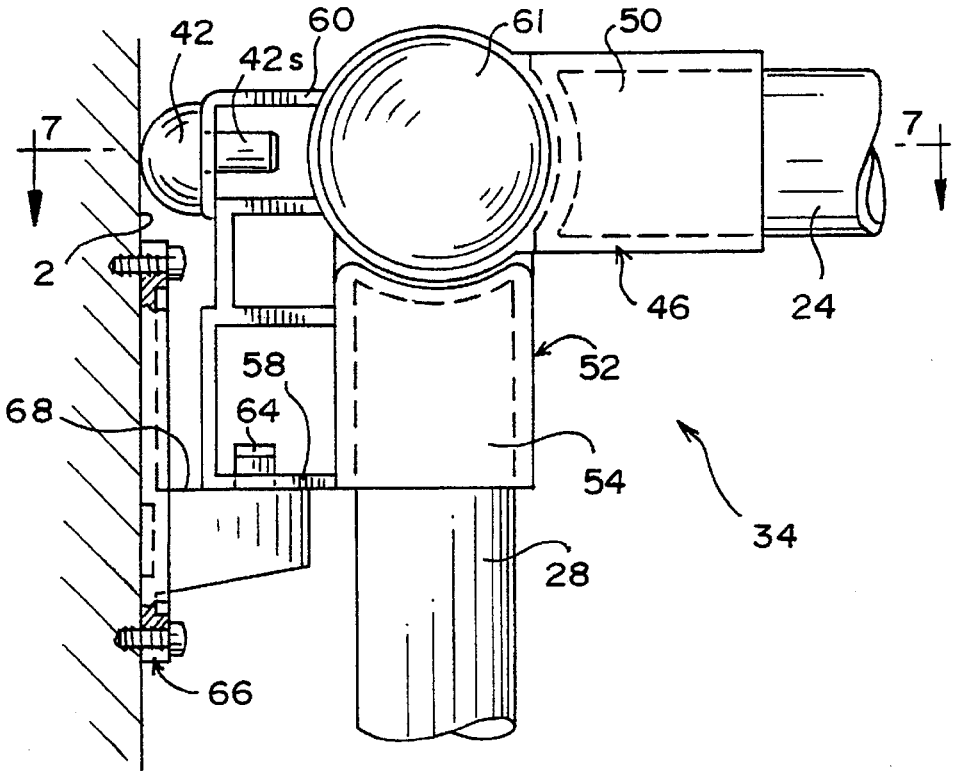
FIG. 5 is an enlarged front view of the upper left corner pivot assembly.
Figure 6:
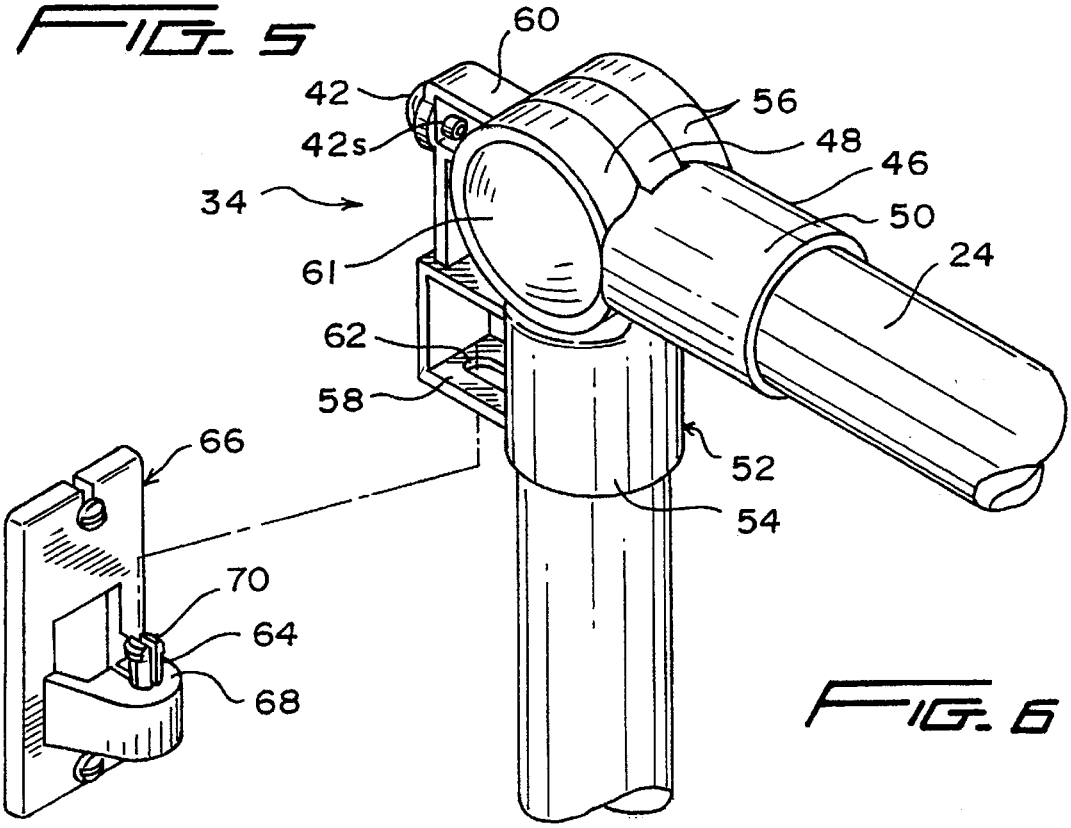
FIG. 6 is a perspective view of the upper left corner pivot assembly.
Figure 12:
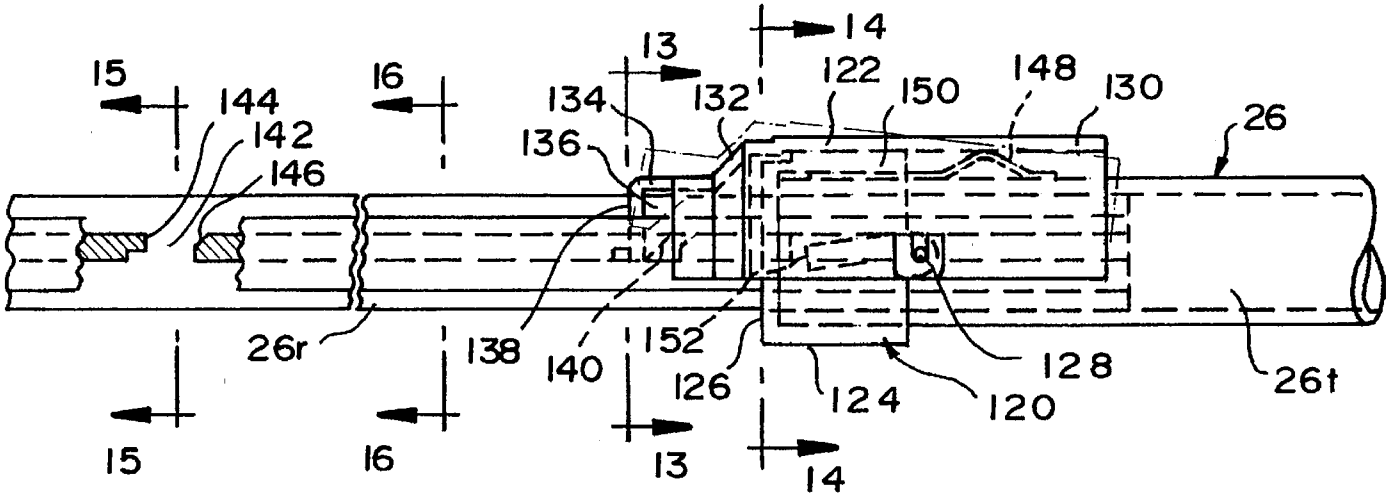
FIG. 12 is a side view of a latching mechanism used in the horizontal bars of the frame of FIG. 2.
Figure 16:
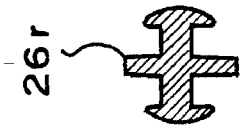
FIGS. 13, 14, 15 and 16 are sectional views of the structure shown in FIG. 12, as seen along the respectively number section lines.
Figure 15:
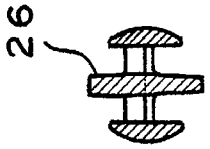
Figure 14:
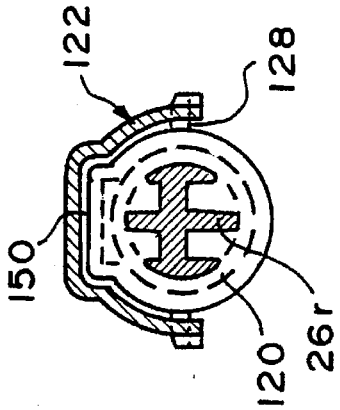
Figure 13:
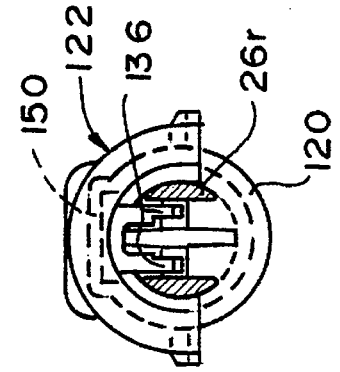
Figure 17:
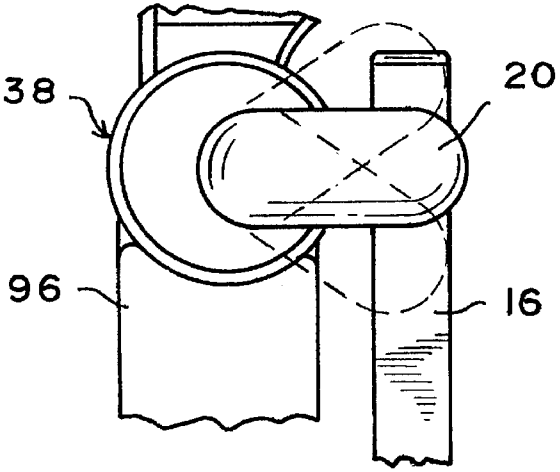
FIG. 17 is an enlarged front view of the corner pivot, link and connector bar at the upper right corner of the device.

Details of the upper left corner pivot assembly 34 are shown in FIGS. 5 and 6. It includes a first corner pivot member 46 and a second corner pivot member 52. The first member 46 has a hinge disc 48 and an end cap 50 which receives the tube portion of the top bar 24. The second member 52 has an end cap 54 for the upper end of the vertical tube 28, two hinge discs 56, a support hinge member 58, and a bumper support portion 60. The discs 56 are spaced apart to receive the disc 48 between them. As shown in FIG. 7, the hinge discs 48 and 56 are pivotally connected together by the hollow stem 61*s* of a hinge cap 61. A screw 63 extends through an opposite hinge cap 65 to retain the stem 61*s* in position. Similar pivots are provided in the other corner pivot assemblies 36, 38 and 40.

The compressible bumper 42 has a stem 42*s* which is retained by an interference fit in a hole in the bumper support portion 60.

The support hinge member 58 has an elongated hole 62 which receives an upwardly projecting pivot pin 64 of a hinge member such as a bracket 66 which is mounted on the wall 2 by screws, adhesive means, or other fasteners. A projecting shoulder 68 on the bracket provides vertical support, and the pivot pin 64 permits swinging movement of the device 6 in the doorway. The pivot pin 64 has an upper peripheral lip 70 which prevents the member 58 from being inadvertently lifted from the hinge bracket 66, but the pin 64 is split so that its halves can be pressed together when it is desired to remove the frame from the hinge bracket 66. Due to the elongated configuration of the hole 62 in the support hinge member 58, the frame can move horizontally toward and away from the wall 2 so that the bumper 42 can contact the wall when the device is being set in its locked position.

FIG. 8 illustrates the lower left corner pivot assembly 36. It includes an upper member 72 and a lower member 74. The lower member 74 includes a body 76, two spaced apart tongues 78 which extend upwardly from the body 76, and an elongated horizontal rod **26*r* which extends horizontally from the body 76 and is an element of the bottom bar 26 of the frame 8**.

The upper member 72 of the lower left corner pivot assembly 36 has an end cap 82 for receiving the lower end of tubular bar 28, a hinge disc 83 which is received between the hinge discs 78, a support hinge portion 84 with an elongated hole 86 which receives the hinge pin 88 on wall bracket 89 which is identical to the previously-described bracket 66, and a bumper support 90 which receives the stem of a bumper 92 which frictionally engages the vertical surface 2 of the doorway. The length of opening 86 is substantially larger than the diameter of the pin 88, so the corner pivot assembly 36 is relatively movable in a horizontal direction with respect to the wall surface 2. The hinge discs 78 and 83 are connected by a pivot which is the stem of a cap 90 which is substantially identical to the cap 61. In this case, however, the pivot is spaced above the longitudinal axis of the bar 26 so that, as will be subsequently explained, the frame 8 may be fully collapsed to a position where all of its bars are mutually parallel.

The upper right corner pivot assembly 38 is shown in FIGS. 9 and 10. Here, the lower hinge member is a single piece 94 of molded plastic. It includes an end cap 96 which receives the upper end of the vertical bar 30 and a center hinge disc 98 which is substantially circular. The upper hinge member 100 includes a body 102 which is molded integrally with the rod **24*r* of the elongated top bar, and two circular hinge discs 104 which lie on opposite sides of the disc 98. The plastic handle 44 may be integral with or separate from the body 102**.

The link 20 which supports the overcenter bar 16 also provides the pivotal connection between the hinge discs 98 and 104. As shown in FIG. 10, the link 20 is a molded plastic piece which includes a first hollow stem 108 which extends through the discs 98 and 104 to pivotally connect them. The link 20 also has a second hollow stem 110 which extends through the overcenter bar 16 to provide another pivotal connection. On the reverse side of the frame, a corresponding link **20*a* has recesses for receiving screws 112 which engage the stems 108 and 110 to hold the link portions 20 and 20*a*** together.

FIGS. 9–11 also show details of one of the bumpers 18 on the overcenter bar 16. The bumper 18 has a stem 114 which is threaded in a recess in a square bumper support sleeve 116. The spacing of the bumper 18 from the overcenter bar 16 is adjusted by rotating the stem. When a suitable distance is determined, the bumper 18 can be locked in position by turning a knurled locknut 118.

The lower right corner pivot assembly 40 is similar to the upper left corner pivot assembly 34 in the respect that its pivot is located at the intersection of the longitudinal axes of horizontal and vertical bars (26 and 30) of the frame. It is similar to the upper right corner pivot assembly in the respect that its pivot is a hollow stem molded integrally with the link 22 which supports the overcenter bar 16.

The top and bottom bars are both telescopically extensible so the device can be adjusted to a width which is suitable for the doorway. As shown in FIGS. 12–16, the bottom bar 26 includes a tube portion **26*t*, and a rod portion 26*r* which is slidably received in the tube portion 26*t***.

An end cap 120 is fixed to the end of the tube **26*t* to guide the sliding movement of the rod 26*r* relative to the tube 26*t* and to support a pivoted latch 122 which locks the rod 26*r*** against inward sliding movement.

The end cap 120 has a cylindrical portion 124 and a transverse end wall 126. The cylindrical portion 124 is rigidly mounted on the tube, **26*t* and the end wall 126 has a cruciform opening which slidably receives and guides the rod 26*r*** which has a corresponding cross sectional shape.

The latch 122 is pivoted on horizontal pivot stubs 128 which extend radially outwardly from axially extending ears on the end cap 120. The latch member includes a generally semicylindrical main portion 130, a semiconical transition portion 132, and a semicylindrical forward portion 134 which supports two laterally spaced teeth 136.

Each tooth 136 has a vertical forward edge 138 and an inclined rear edge 140. The teeth are adapted to catch in selected openings 142 in the horizontal webs of the rod **26*r*. Each of these openings 142 also has a vertical forward edge 144 and an inclined rear edge 146, so the rod 26*r* can normally slide outwardly but not inwardly with respect to the tube 26*t***.

Movement of the teeth 136 into the openings 142 is biased by a flat spring 148 which exerts an upward force on the upper interior wall of the main body of latch 122. The base of the spring 148 is held between the outer wall of the tube **26*t* and a flat upper wall portion 150** of the cap.

To prevent the rod **26*r* from extending so far that it separates entirely from the tube 26*t*, the horizontal web of the rod 26*r* has an abutment surface 152 which will engage the interior surface of the cap end wall 126 to stop the sliding movement of the rod 26*r***.

From the foregoing, the manner of operating the device of FIGS. 1–18 will be evident. The optional support hinge brackets 66 and 89 are mounted on doorway surface 2, and the elongated holes 62 and 86 on frame 8 are mounted on the stationary hinge pins 64 and 88. The horizontal bars 24 and 26 are extended to an appropriate length, and the protrusion distances of the bumpers 18 are adjusted so that the device will properly lock and unlock from the doorway. The user, grasping the handle 44, raises the right vertical bar 30 to the position shown in double dot lines in FIG. 2. At this time, the right side of the frame will be in the position shown in FIG. 4. The handle 44 is then moved downwardly until the frame is in the position shown in FIG. 3 and in the configuration shown in solid lines in FIG. 2. During this movement, the bumpers on the left side of the frame are able to move leftwardly due to the elongated support hinge openings 62 and 86.

Figure 18:
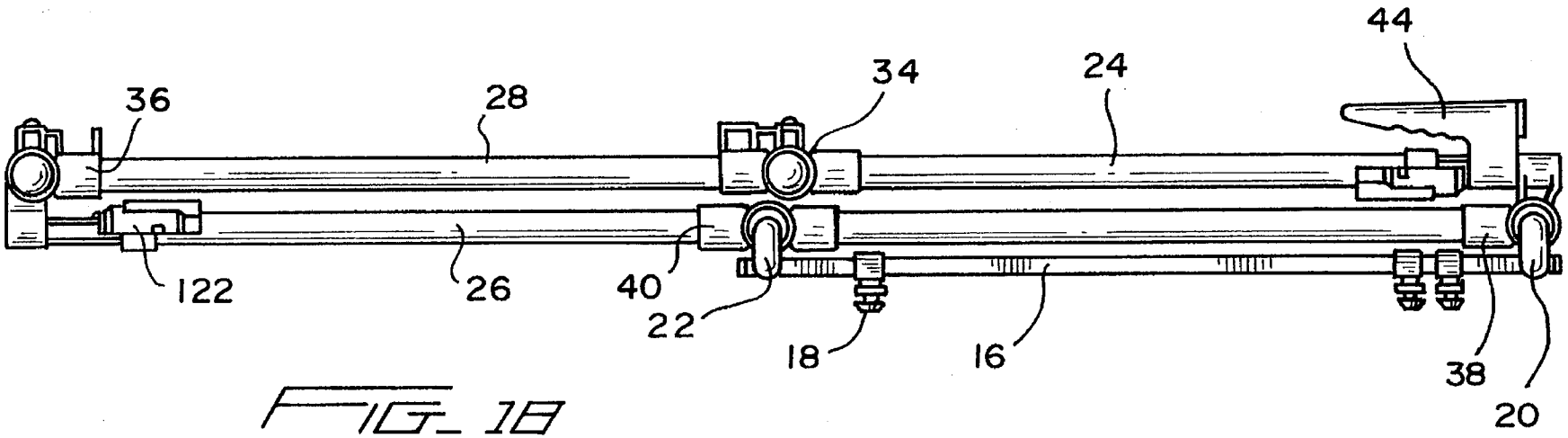
FIG. 18 is a front view showing the device of FIG. 1 in its fully collapsed position. The fabric barrier, although actually present, has been omitted from the drawing to facilitate an understanding of the frame structure.

When it is desired to store the device, the bars 24 and 26 are shortened and the frame 8 is collapsed until all of the bars 24, 26, 28 and 30 are parallel as shown in FIG. 18. This compact position is possible because the diametrically opposed corner pivot assemblies 36 and 38 have their pivots inwardly offset from the respective horizontal bars 26 and 24. Due to the shape and orientation of the rectangular openings in the nylon netting, the fabric does not impede this folding action.

Figure 19:
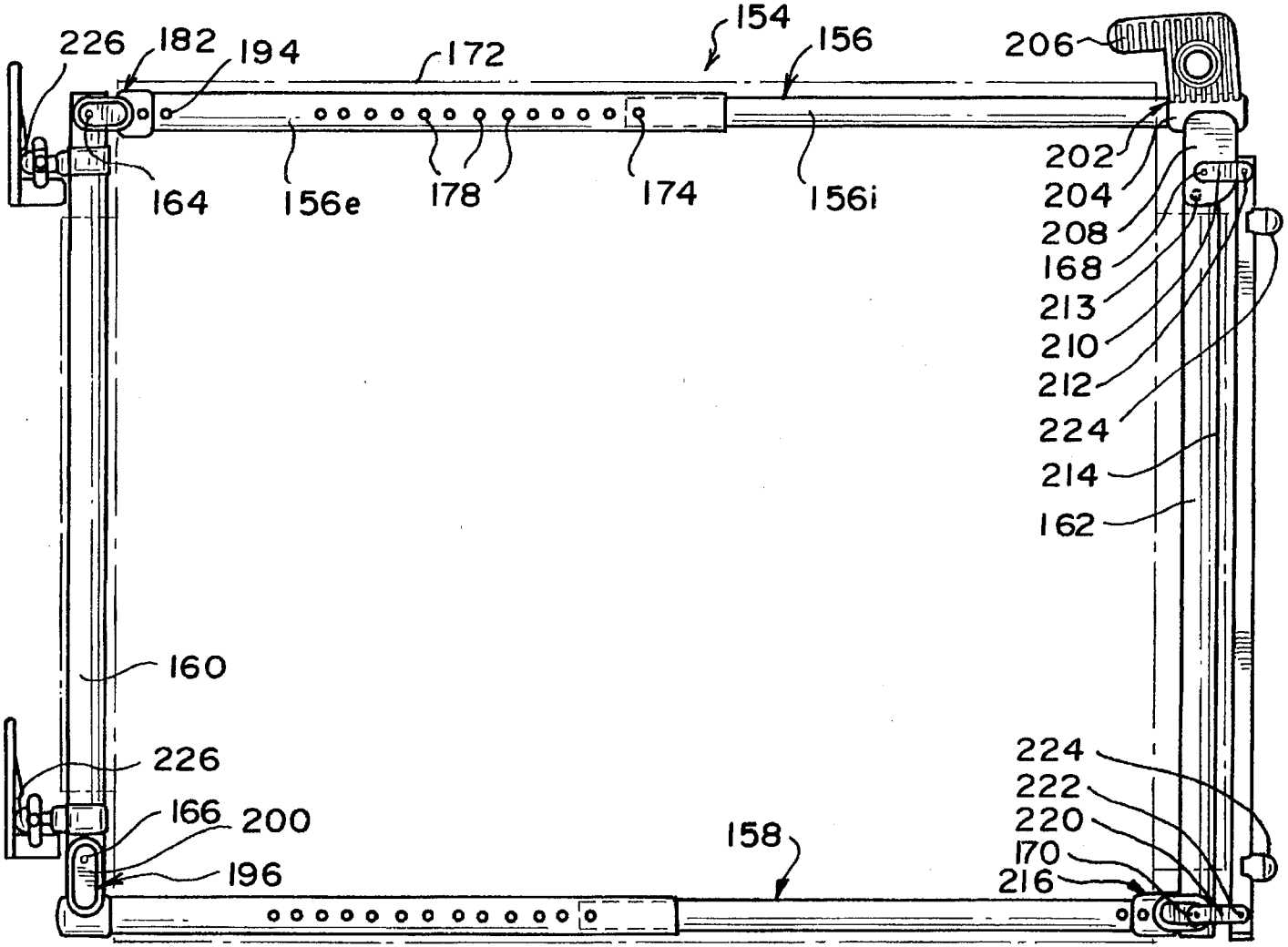
FIG. 19 is a front view of a frame utilized in a second embodiment of the invention.

A second preferred embodiment is shown in FIGS. 19–22, in which the bars of the frame are formed exclusively of tubular members, and the corner pivots are less complex and less costly than in the embodiment of FIGS. 1–18. As shown in FIG. 19, a rectangular frame 154 is formed of a top bar 156, a bottom bar 158, a left side bar 160 and a right side bar 162. The frame 154 is also a collapsible parallelogram as the bars 154, 156, 158 and 160 are connected to each other by pivots 164, 166, 168 and 170 which have parallel axes. A fabric member of the type shown at 14 in FIG. 1 is mounted on the frame 154 as shown in dot dash lines 172 to obstruct the central area defined by the tubular bars. To facilitate folding of the frame, the fabric is a net made of yarns which are parallel to the bars and are arranged to form rectangular openings. As can be seen in FIG. 1, the net is supported on the bars of the frame. Thus, each of the horizontal strands of the net has ends which are connected to the side bars 160 and 162 so that they are horizontally immovable with respect thereto. Likewise, each of the vertical strands of the net has its upper and lower ends connected to the bars 156 and 158 so that they are vertically immovable with respect to these respective bars.

The top and bottom bars 156 and 158 are substantially identical. The top bar 156 is formed of inner and outer tube sections **156*i* and 156*e* which are telescopically interfitted to permit sliding action which varies its overall length. These sections 156*i* and 156*e* are normally locked against sliding action by a conventional dual snap button device when the tube 156 is at an appropriate length. Snap buttons are well known and are widely available from various sources including Valley Tool and Die, Inc., East Royalton, Ohio. The snap button assembly includes two diametrically opposed buttons 174 mounted on a U-shaped leaf spring which is fixed inside the inner tube section 156*i*. These buttons 174 project through holes on opposite sides of the tube section 156*i* and into selected holes 178 formed in the outer tube section 156*e*. The buttons are shaped with sloping surfaces so that the telescopic tube sections can slide apart freely when the tube is being lengthened. However, to shorten the tube, the buttons 174** must be manually depressed.

Figures 20, 21, 22:
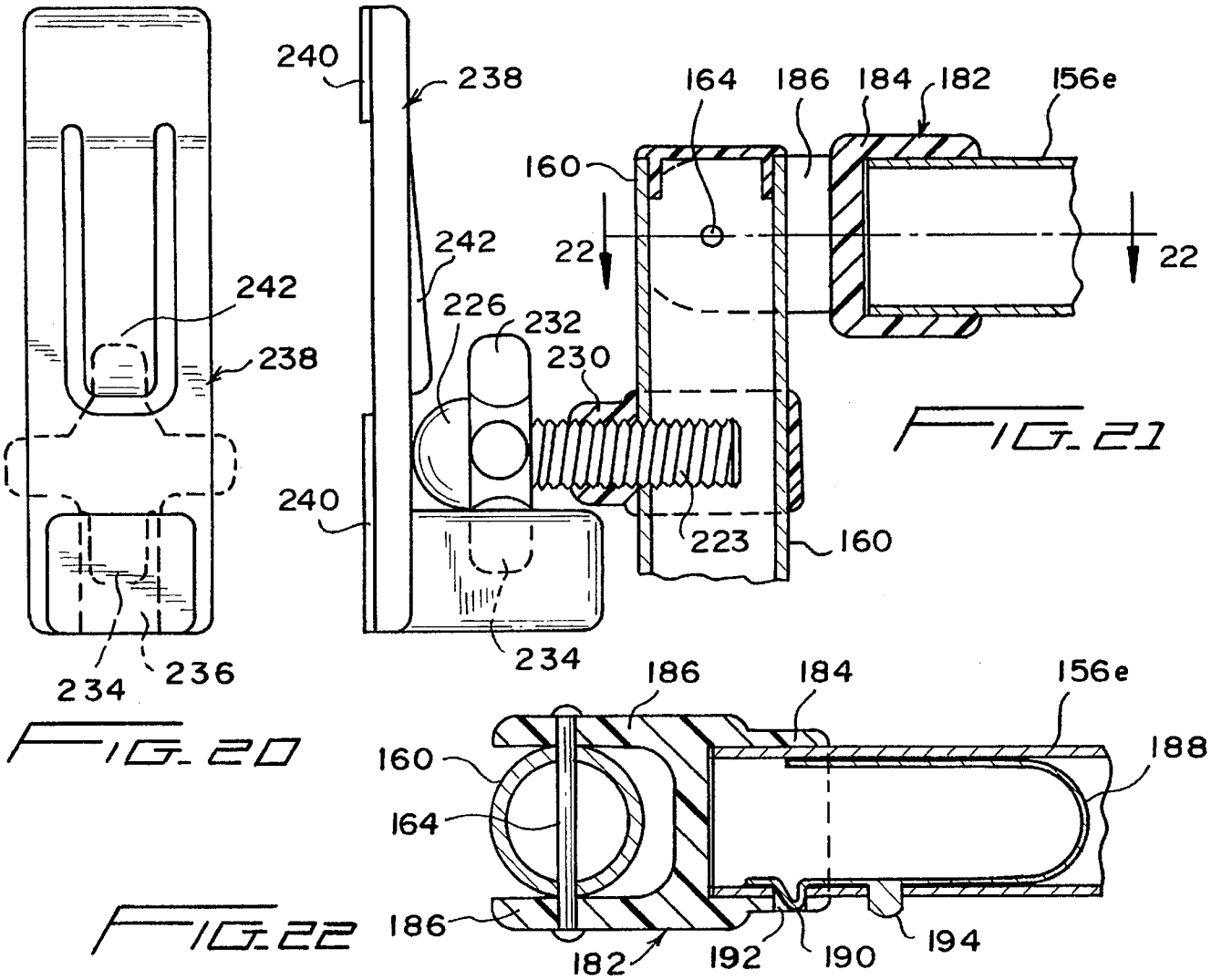
FIG. 20 is a view of the face of a wall mounted hinge bracket used in the embodiment of FIG. 19.
FIG. 21 is an enlarged view of the upper left hinge and pivot structures utilized in the embodiment of FIG. 19.
FIG. 22 is a sectional view of the pivot structure as seen along the line 22—22 in FIG. 21.

The pivot assembly which connects the left end of the top tube 156 to the upper end of the vertical tube 160 is shown in FIG. 21. A molded plastic end piece 182 mounted on tube section **156*e* includes a cap 184 for the end of the tube and a pair of axially projecting flat tongues 186 which are spaced apart to accommodate the upper end of the tube. The pivot pin 164, preferably a rivet, extends through the tongues 186 and through the tube 160 to provide a pivotal connection at the intersection of the longitudinal axes of the bars 156 and 160**.

The end piece 182 is normally fixed to the top tube 156 by a latch type snap button which, as shown in FIG. 22, includes a U-shaped leaf spring 188, a latch button 190 which projects into a hole 192 in the end cap 184, and an actuating button 194 which protrudes from a hole in the tube **156*e*. The end piece 182 can be removed from the top tube 156 for packing and storage, simply by depressing the button 194 and pulling the end piece 182 off of the tube 156**.

As shown in FIG. 19, the lower left pivot assembly has an offset pivot in the respect that its pivot 166 is offset from the longitudinal axis of one of the interconnected tubes, e.g. tube 158. This pivot assembly includes an end piece 196 with an end cap and a pair of spaced apart parallel tongues 200. The end cap is permanently attached to the left end of the bottom tube 158. The tongues 200 extend transversely to the axis of the bottom tube 158. The pivot pin 166 extends through the tongues 200 and through the tube 160 at a location which is spaced inwardly from the longitudinal axis of the bottom tube 158.

The upper right corner of the frame has an integrally molded plastic end piece 202 which includes an end cap 204, an L-shaped handle 206, and two spaced apart tongues 208 which extend down from the end cap 204. The pivot pin 168 extends through these tongues 208 and through diametrically opposed holes in the upper end portion of the vertical tube 162. Thus, the pivot 168 is offset inwardly with respect to the longitudinal axis of the top tube 156. This pivot 156 also supports two adjacent and parallel links 210 which have their outboard ends connected by a pivot 212 to the locking bar 214. These links are molded pieces similar to the links 20 and 22, but they may be assembled with rivets rather than screws.

One or both of the tongues 208 is provided with a generally hemispherical bump or detent 213 which faces toward the other tongue and lies in the path which the tube 162 will follow when the left vertical tube 160 is raised to collapse the frame 154. As will be subsequently explained, this detent 213 prevents the frame from collapsing excessively when it is moved from place to place. However, it can be overridden forcibly when it is desired to collapse the frame fully for storage purposes.

At the lower right corner of the frame, the bottom tube 158 has an end piece 216 which is identical in structure and function to the upper left end piece, except that its tube end cap has an inside diameter which is smaller since it receives the inner telescoping tube. The pivot 170 also supports the inboard ends of two lower links 220. The outboard ends of these links 220 are connected to the locking bar 214 by a pivot 222.

The locking bar 214 is provided with two pressure members, preferably compressible resilient bumpers 224. They are movable with the locking bar but they are not adjustable relative to it. They are movable in the respect that they move laterally outwardly from the side bar 162 when the bar 162 is moved downwardly with respect to the locking bar 214 and bumpers 224.

In the embodiment of FIGS. 19–22, the doorway-engaging pressure members on the left side of the frame are horizontally adjustable fixed bumpers 226. Referring to FIG. 21, it will be seen that the bumper 226 is at the end of a shaft 228 which is threaded to the boss of a plastic collar 230. The collar 230 is mounted on the tube 160. The shaft 228 extends through a hole in the tube 160 to retain the collar 230 at a vertically fixed location. The shaft 228 is manually rotated by turning a knob 232 which consists of four pins which radiate from a central hub. The pin 234 which extends downwardly also serves as the frame-supporting hinge pin. It is inserted in a horizontally elongated opening 236 of a bracket 238 which is mounted on the doorway surface by double stick mounting tape 240. The pin 234 is horizontally slidable toward and away from the doorway surface until the bumper 224 is in frictional engagement with the bracket 238 which constitutes the left surface of the doorway.

As can be seen in FIG. 21, the pin 234 is prevented from lifting out of the opening 236 by a resilient tongue 242 which protrudes from the bracket 238 to obstruct upward movement of the bumper 224, the knob 232, and the associated left side of the frame 154.

The gate shown in FIGS. 19–22 can be used with or without the hinge brackets 238. When it is used without the hinge brackets, it is initially positioned in a doorway, and the top and bottom tubes 156 and 158 are lengthened until the width of the frame is suitable for the doorway. The projection distances of the fixed bumpers 226 are adjusted by turning the knobs 232. The left side bar 160 is vertically positioned where its bumpers 226 engage the doorway surface, and the top and bottom bars 156 and 158 are inclined slightly upwardly from left to right. The top and bottom bars are then moved downwardly toward the horizontal until the movable bumpers 224 on the locking bar 214 engage the right surface of the doorway to impede further downward movement of the locking bar 214. Continued downward movement of the right side bar 162 results in counterclockwise rotation of the links 210 and 220 on pivots 168 and 170, and outward movement of the bumpers 224 relative to the right side bar 162 so they exert pressure and friction on the doorway to keep the device in position.

To remove the device from the doorway, the handle 206 is lifted to raise the right side bar 162, thus producing clockwise rotation of the links 210 and 220 on the pivots 168 and 170, and leftward movement of the locking bar 214. This releases the bumpers 224 from the right surface of the doorway. At this time, to prevent the frame from collapsing excessively, the detent button 213 engages the outer wall of the tube 162 so that the angle between the tubes 156 and 162 does not decrease to less than about 70 degrees. Concomitantly, the detent 213 limits the upward inclination of the top and bottom bars to an angle no more than about 20 degrees. This prevents the frame 154 from collapsing excessively. If it is desired to collapse the device fully for storage, additional force will permit the wall of tube 162 to move past the detent 213 until the frame is folded to a position where all of the tubes 156, 158, 160 and 162 are parallel.

When the hinge supports 238 are used, they are initially attached to the doorway by the double stick tape 240. The downwardly extending pins 234 of the knobs 232 are inserted in the openings 236 in the hinge brackets 238, and the device is operated in the same manner as previously described. When the handle 206 is lifted and locking bar 214 is released, the gate can swing horizontally about the vertical hinge axis defined by the pins 234. If desired, the corner pivot assemblies may be provided with releasable detents which keep the bars in their slightly inclined positions until the gate is again locked in the doorway. The end pieces can be constructed so that the end pieces 182 and 216 prevent their respective bars from moving together to angles of less than about 90°; and, the end pieces 196 and 202 prevent their respective bars from moving apart to angles of more than about 90°

Persons familiar with the field of the invention will realize that it may be practiced by a wide variety of devices which differ from the particular embodiments described in this specification. Therefore, it is emphasized that the invention is not limited to the disclosed embodiments but it embracing of a variety of other structures which fall within the spirit of the following claims.

We claim:

1. A security gate for obstructing movement of children or animals through an entryway which has its opposite sides defined laterally by a first surface and a second surface, comprising, a frame including a horizontal top bar, a horizontal bottom bar, a first vertical side bar, and a second vertical side bar, said bars being substantially linear and rigid and being connected together to form one parallelogram which extends substantially entirely across the entryway, said bars forming boundaries of a central area;

a first pivot which pivotally connects the first vertical side bar to the top bar; a second pivot which pivotally connects the first vertical side bar to the bottom bar; a third pivot which pivotally connects the second vertical side bar to the top bar; and a fourth pivot which pivotally connects the second vertical side bar to the bottom bar;

said pivots having pivot axes which are substantially parallel;

a barrier mounted on said frame to obstruct said central area to prevent a child or animal from moving through the entryway;

at least one fixed pressure member mounted at a fixed position on said first vertical side bar for pressing against the first surface of the entryway;

at least one movable pressure member movably supported on said second vertical side bar for pressing against the second surface of the entryway, said movable pressure member being movable vertically and horizontally relative to said second vertical side bar, said movable pressure member being movable laterally outwardly from said second vertical side bar in response to downward movement of said second vertical side bar relative to said movable pressure member.

2. A security gate according to claim 1, including an overcenter bar on which said movable pressure member is mounted, a pair of parallel links which movably support the overcenter bar on the second vertical side bar, each of said links having two spaced apart pivots which are respectively located on said second vertical side bar and said overcenter bar.

3. A security gate according to claim 2, wherein each of said links has a said pivot with an axis which coincides with the axis of one of the third and fourth pivots.

4. A security gate according to claim 1, having a frame-supporting hinge which includes a first hinge member provided with a hinge pin and a second hinge member provided with an opening which receives said hinge pin, said opening being substantially larger than said hinge pin so that the first and second hinge members are relatively movable in a horizontal direction.

5. A security gate according to claim 4, wherein said fixed pressure member is mounted on one of said hinge members has a pressure member for frictionally engaging said first surface.

6. A security gate according to claim 1, wherein said first vertical side bar is at a fixed elevation and said second vertical side bar is vertically movable.

7. A security gate according to claim 1, having a releasable detent for limiting the upward inclination of at least one of the top and bottom bars when the second vertical side bar is raised relative to said first vertical side bar.

8. A security gate according to claim 7, wherein said detent limits the upward inclination of at least one of said top and bottom bars to an angle of no more than about 20 degrees.

9. A security gate for obstructing movement of children or animals through an entryway which has its opposite sides defined laterally by a first surface and a second surface, comprising, a frame including a horizontal top bar, a horizontal bottom bar, a first vertical side bar, and a second vertical side bar, said bars being substantially linear and rigid and being connected together to form one parallelogram which extends substantially entirely across the entryway, said bars forming boundaries of a central area;

a first pivot which pivotally connects the first vertical side bar to the top bar; a second pivot which pivotally connects the first vertical side bar to the bottom bar; a third pivot which pivotally connects the second vertical side bar to the top bar; and a fourth pivot which pivotally connects the second vertical side bar to the bottom bar;

said pivots having pivot axes which are substantially parallel;

a barrier formed of flexible sheet material mounted on the frame to prevent a child or animal from passing through the frame;

said flexible sheet material having horizontal and vertical elongated flexible members which are substantially parallel to said bars and are interconnected to form a net which has rectangular openings;

each of said horizontal elongated flexible members having ends which are connected to said first and second vertical side bars and are horizontally immovable with respect to said first and second vertical side bars;

each of said vertical elongated flexible members having ends which are connected to the top bar and the bottom bar and are vertically immovable with respect to said top bar and bottom bar.

10. A security gate according to claim 9, having an overcenter bar which is adjacent and parallel to the second vertical side bar;

two parallel links mounting the overcenter bar on said second vertical side bar, said links being vertically swingable to change the effective overall width of the security gate by changing the distance between the overcenter bar and the second vertical side bar, a pressure surface on said overcenter bar for frictionally engaging the second surface of the entryway when the effective overall width of the security gate is increased due to swinging movement of said links.

11. A security gate according to claim 10, wherein each of said links swings on an axis which coincides with the axis of one of the third and fourth pivots.

12. A security gate according to claim 9, having a frame-supporting hinge which includes a first hinge member provided with a hinge pin and a second hinge member provided with an opening which receives said hinge pin, said opening being substantially larger than said hinge pin so that the first and second members are relatively movable in a horizontal direction.

13. A security gate according to claim 12, wherein one of said hinge members has a pressure member for frictionally engaging said first surface.

14. A security gate according to claim 9, wherein said first vertical side bar is at a fixed elevation and said second vertical side bar is vertically movable.

15. A security gate according to claim 9, having a releasable detent for limiting the upward inclination of at least one of the top and bottom bars when the second vertical side bar is raised relative to said first vertical side bar.

16. A security gate according to claim 15, wherein said detent limits the upward inclination of at least one of said top and bottom bars to an angle of no more than about 20 degrees.

17. A security gate for obstructing movement of children or animals through an entryway which has its opposite sides defined laterally by a first surface and a second surface, comprising, a frame including a horizontal top bar, a horizontal bottom bar, a first vertical side bar, and a second vertical side bar, said bars being substantially linear and rigid and being connected together to form one parallelogram which extends substantially entirely across the entryway, said bars forming boundaries of a central area;

a first pivot which pivotally connects the first vertical side bar to the top bar; a second pivot which pivotally connects the first vertical side bar to the bottom bar; a third pivot which pivotally connects the second vertical side bar to the top bar; and a fourth pivot which pivotally connects the second vertical side bar to the bottom bar;

said pivots having pivot axes which are substantially parallel;

a barrier member mounted on the frame to prevent a child or animal from passing through the frame;

two of said pivots being diagonally opposed to each other, each of said diagonally opposed pivots having a pivot axis which is inwardly offset from the longitudinal axis of at least one of the bars which it interconnects to permit said frame to collapse until all four bars are substantially parallel.

18. A security gate according to claim 17, having an overcenter bar which is adjacent and parallel to the second vertical side bar;

two parallel links mounting the overcenter bar on said second vertical side bar, said links being vertically swingable to change the effective overall width of the security gate by changing the distance between the overcenter bar and the second vertical side bar, a pressure surface on said overcenter bar for frictionally engaging the second surface of the entryway when the effective overall width of the security gate is increased due to swinging movement of said links.

19. A security gate according to claim 18, wherein each of said links swings on an axis which coincides with the axis of one of the third and fourth pivots.

20. A security gate according to claim 17, including a frame-supporting hinge which includes a first hinge member provided with a hinge pin and a second hinge member provided with an opening which receives said hinge pin, said opening being substantially larger than said hinge pin so that the first and second members are relatively movable in a horizontal direction.

21. A security gate according to claim 20, wherein one of said hinge members has a pressure member for frictionally engaging said first surface.

22. A security gate according to claim 17, wherein said first vertical side bar is at a fixed elevation and said second vertical side bar is vertically movable.

23. A security gate according to claim 17, having a releasable detent for limiting the upward inclination of at least one of the top and bottom bars when the second vertical side bar is raised relative to said first vertical side bar.

24. A security gate according to claim 23, wherein said detent limits the upward inclination of at least one of said top and bottom bars to an angle of no more than about 20 degrees.

25. A security gate for obstructing movement of children or animals through an entryway which has its opposite sides defined laterally by a first surface and a second surface, comprising, a frame including a horizontal top bar, a horizontal bottom bar, a first vertical side bar, and a second vertical side bar, said bars being substantially linear and rigid and being connected together to form one parallelogram which extends substantially entirely across the entryway, said bars forming boundaries of a central area;

a first pivot which pivotally connects the first vertical side bar to the top bar; a second pivot which pivotally connects the first vertical side bar to the bottom bar; a third pivot which pivotally connects the second vertical side bar to the top bar; and a fourth pivot which pivotally connects the second vertical side bar to the bottom bar;

said pivots having pivot axes which are substantially parallel;

a barrier member mounted on the frame to prevent a child or animal from passing through the frame;

a frame-supporting hinge for supporting the frame from said first surface, said hinge having a generally vertical hinge axis to permit horizontal swinging movement of said security gate;

said frame-supporting hinge including a first hinge member provided with a hinge pin and a second hinge member provided with an opening which receives said hinge pin, said opening being substantially larger than said hinge pin so that the first and second members are relatively movable in a horizontal direction.

26. A security gate according to claim 25, having an overcenter bar which is adjacent and parallel to the second vertical side bar;

two parallel links mounting the overcenter bar on said second vertical side bar, said links being vertically swingable to change the effective overall width of the security gate by changing the distance between the overcenter bar and the second vertical side bar, a pressure surface on said overcenter bar for frictionally engaging the second surface of the entryway when the effective overall width of the security gate is increased due to swinging movement of said links.

27. A security gate according to claim 26, wherein each of said links swings on an axis which coincides with the axis of one of the third and fourth pivots.

28. A security gate according to claim 25, wherein one of said hinge members has a pressure member for frictionally engaging said first surface.

29. A security gate according to claim 25, wherein said first vertical side bar is at a fixed elevation and said second vertical side bar is vertically movable.

30. A security gate according to claim 25, having a releasable detent for limiting the upward inclination of at least one of the top and bottom bars when the second vertical side bar is raised relative to said first vertical side bar.

31. A security gate according to claim 30, wherein said detent limits the upward inclination of at least one of said top and bottom bars to an angle of no more than about 20 degrees.

* * * * *